US010508006B1

(12) United States Patent
Marianetti

(10) Patent No.: US 10,508,006 B1
(45) Date of Patent: Dec. 17, 2019

(54) TRUCK BED CARGO HOIST

(71) Applicant: Johnny Marianetti, Redwood, CA (US)

(72) Inventor: Johnny Marianetti, Redwood, CA (US)

( * ) Notice: Subject to any disclaimer, the term of this patent is extended or adjusted under 35 U.S.C. 154(b) by 204 days.

(21) Appl. No.: 15/819,211

(22) Filed: Nov. 21, 2017

(51) Int. Cl.
*B66C 23/00* (2006.01)
*B66C 23/38* (2006.01)
*B66C 23/64* (2006.01)

(52) U.S. Cl.
CPC ..... *B66C 23/38* (2013.01); *B66C 23/64* (2013.01)

(58) Field of Classification Search
CPC ..... B66C 17/04; B66C 17/06; B66C 23/02; B66C 23/022; B66C 23/025; B66C 23/08; B66C 23/16; B66C 23/18; B66C 23/202; B66C 23/36; B66C 23/44; B66C 2700/0357; B66C 2700/0364
See application file for complete search history.

(56) References Cited

U.S. PATENT DOCUMENTS 2,446,488 A * 8/1948 Pierce ..... B66C 13/18 414/543
3,019,918 A * 2/1962 Keener ..... B66C 23/36 414/543
3,048,371 A 8/1962 Klimek
4,069,922 A * 1/1978 Hawkins ..... B66C 23/42 212/181
4,463,858 A * 8/1984 Bilas ..... B60P 1/5428 212/176
4,881,864 A * 11/1989 Amato ..... B60R 9/06 414/543
D349,996 S 8/1994 Litwiller
5,431,526 A * 7/1995 Peterson ..... B60P 1/5433 212/223
5,749,697 A * 5/1998 Davis ..... B66C 23/44 212/253
6,138,991 A * 10/2000 Myers, Jr. ..... B66C 23/44 212/180
6,189,866 B1 * 2/2001 Harkins ..... B66C 23/44 212/176
6,425,727 B1 7/2002 Hood
6,860,703 B2 3/2005 Carroll, Jr.
7,350,770 B1 * 4/2008 Boyer ..... B66C 23/02 212/295
7,377,740 B2 * 5/2008 Panzarella ..... B60P 1/5433 212/180

(Continued)

*Primary Examiner* — Emmanuel M Marcelo

(57) ABSTRACT

The truck bed cargo hoist is configured for use with a load. The truck bed cargo hoist is configured for use with a pickup truck. The pickup truck is further defined with a bed. The truck bed cargo hoist is mounted in the bed of the pickup truck. The truck bed cargo hoist is configured for use in raising the load in the superior direction. The truck bed cargo hoist comprises a slewing structure, a stanchion, a jib, a plurality of gussets, and a hoist system. The slewing structure, the stanchion, the jib, and the plurality of gussets form the framework that supports the hoist system. The hoist system raises and lowers the load. The stanchion, the jib, and the plurality of gussets are interconnected. The slewing structure attaches the stanchion to the bed of the pickup truck such that the yaw angle of the jib is adjustable.

17 Claims, 5 Drawing Sheets

(56) References Cited

U.S. PATENT DOCUMENTS

| | | | | |
|---|---|---|---|---|
| 7,536,965 | B2 * | 5/2009 | Johnson | B63C 3/06 114/44 |
| 8,684,136 | B2 * | 4/2014 | Chilton | A62B 1/06 182/3 |
| 9,327,947 | B2 * | 5/2016 | Davis | B66C 23/44 |
| 9,630,816 | B1 * | 4/2017 | Napieralski | B66C 23/06 |
| 9,877,490 | B1 * | 1/2018 | Lee | A22B 5/06 |
| 2002/0066710 | A1 * | 6/2002 | Spitsbergen | B66C 23/44 212/179 |
| 2004/0256607 | A1 * | 12/2004 | Spitsbergen | B66C 23/44 254/334 |
| 2007/0290181 | A1 | 12/2007 | Bell | |
| 2011/0053482 | A1 * | 3/2011 | McKenzie | A22B 5/06 452/187 |
| 2012/0294700 | A1 * | 11/2012 | Ervin | B66C 23/44 414/550 |
| 2013/0280020 | A1 * | 10/2013 | O'Brien | B66C 23/36 414/543 |
| 2013/0309054 | A1 * | 11/2013 | Lazos | B66F 9/00 414/543 |
| 2016/0221802 | A1 * | 8/2016 | Almeda | B66C 23/18 |
| 2018/0057334 | A1 * | 3/2018 | Poczciwinski | B66F 19/005 |
| 2018/0099601 | A1 * | 4/2018 | Martinez Romero | B60P 1/5433 |

* cited by examiner

TRUCK BED CARGO HOIST

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hoisting, lifting, and hauling, more specifically, a mobile hoist with a fixed jib capable of slew.

SUMMARY OF INVENTION

The truck bed cargo hoist is configured for use with a load. The truck bed cargo hoist is configured for use with a pickup truck. The pickup truck is further defined with a bed and a direction of forward motion. Optionally, the pickup truck is further defined with a raised structure. The truck bed cargo hoist is mounted on the bed of the pickup truck as well as being attached at the top to a lumber rack. The truck bed cargo hoist is configured for use in raising the load in the superior direction. The truck bed cargo hoist comprises a slewing structure, a stanchion, a jib, a plurality of gussets, and a hoist system. The slewing structure, the stanchion, the jib, and the plurality of gussets form the framework that supports the hoist system. The hoist system raises and lowers the load. The stanchion, the jib, and the plurality of gussets are interconnected. The slewing structure attaches the stanchion to the bed of the pickup truck such that the yaw angle of the jib is adjustable.

These together with additional objects, features and advantages of the truck bed cargo hoist will be readily apparent to those of ordinary skill in the art upon reading the following detailed description of the presently preferred, but nonetheless illustrative, embodiments when taken in conjunction with the accompanying drawings.

In this respect, before explaining the current embodiments of the truck bed cargo hoist in detail, it is to be understood that the truck bed cargo hoist is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the truck bed cargo hoist.

It is therefore important that the claims be regarded as including such equivalent construction insofar as they do not depart from the spirit and scope of the truck bed cargo hoist. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
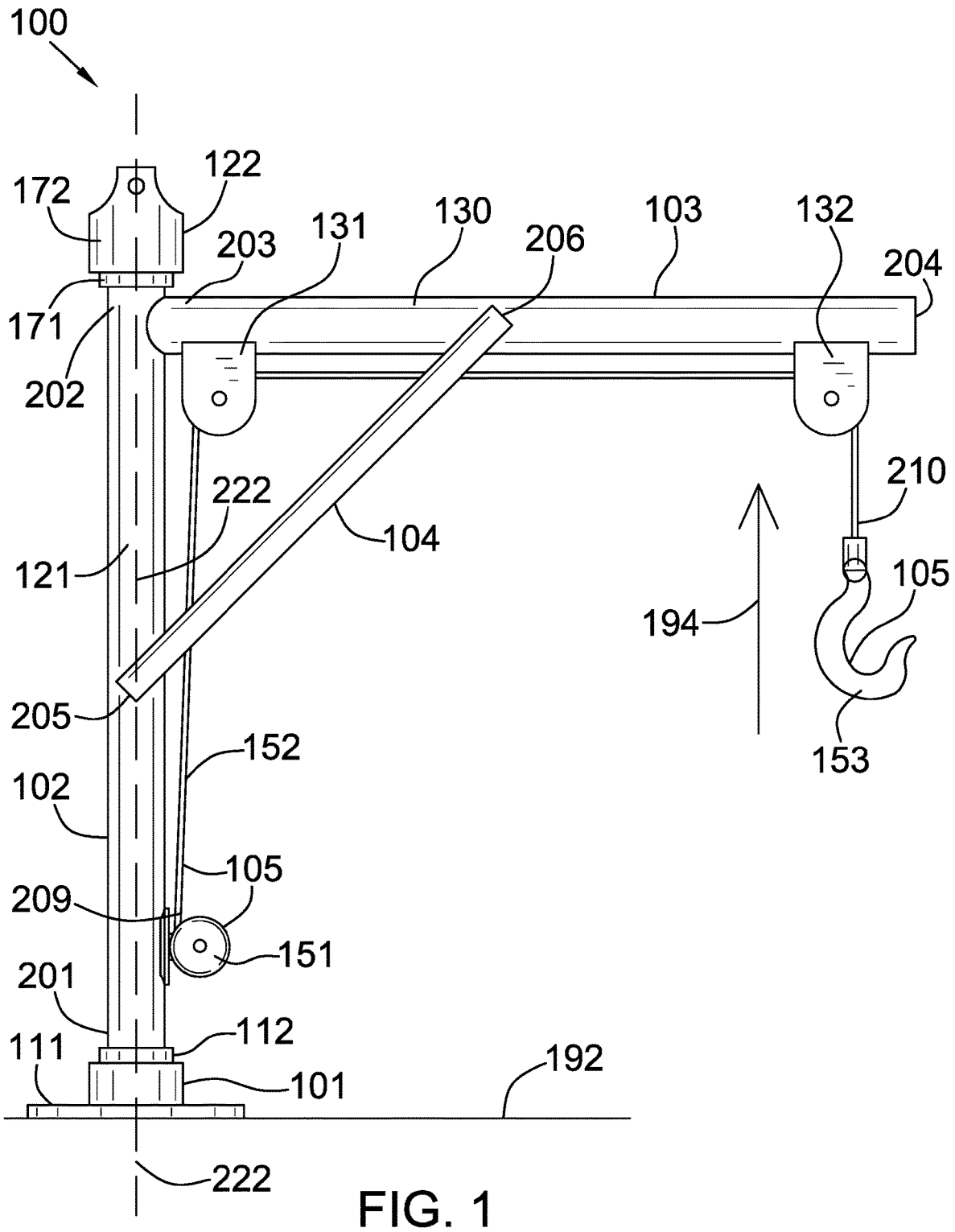
FIG. 1 is a side view of an embodiment of the disclosure.
Figure 2:
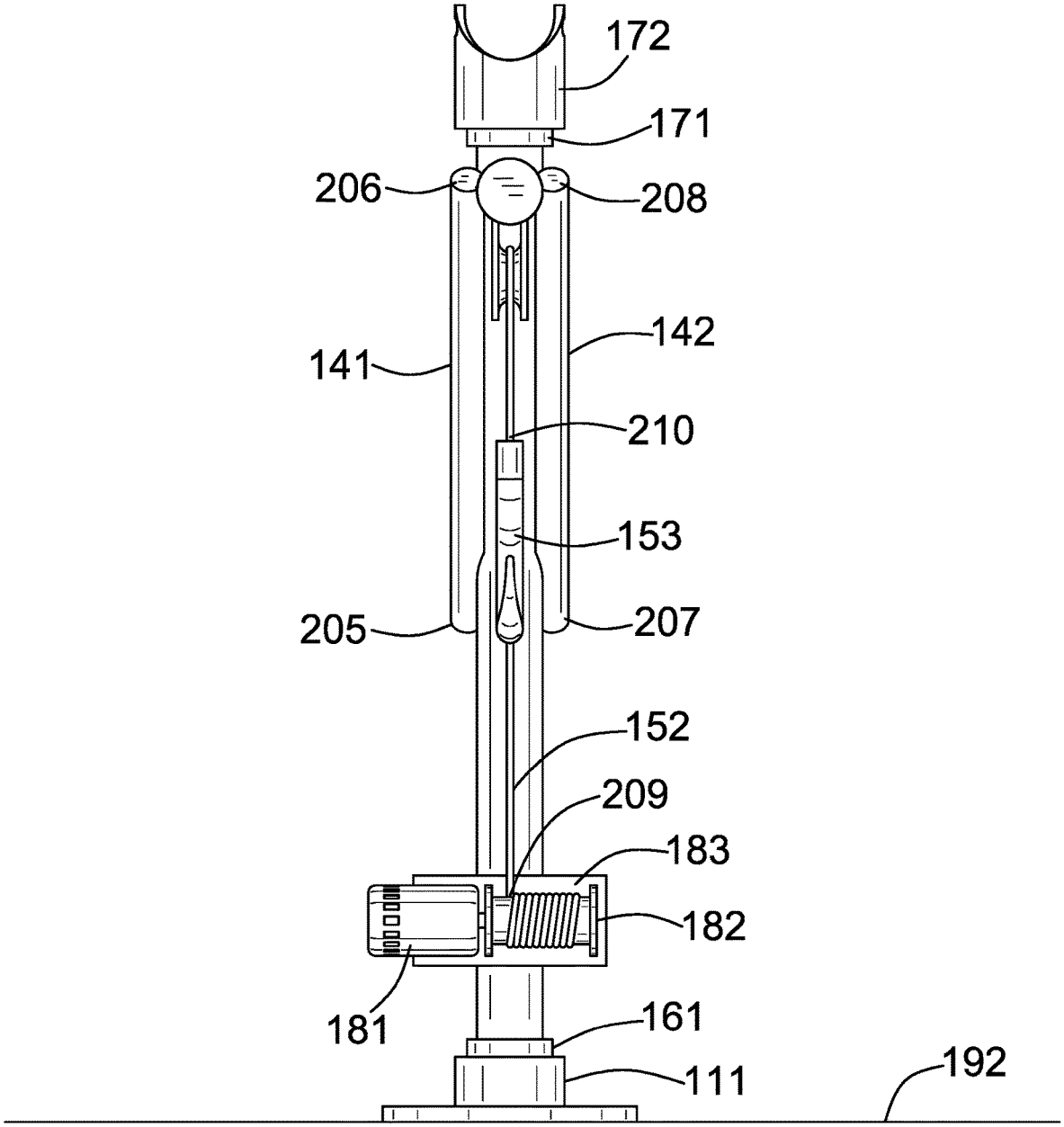
FIG. 2 is a front view of an embodiment of the disclosure.
Figure 3:
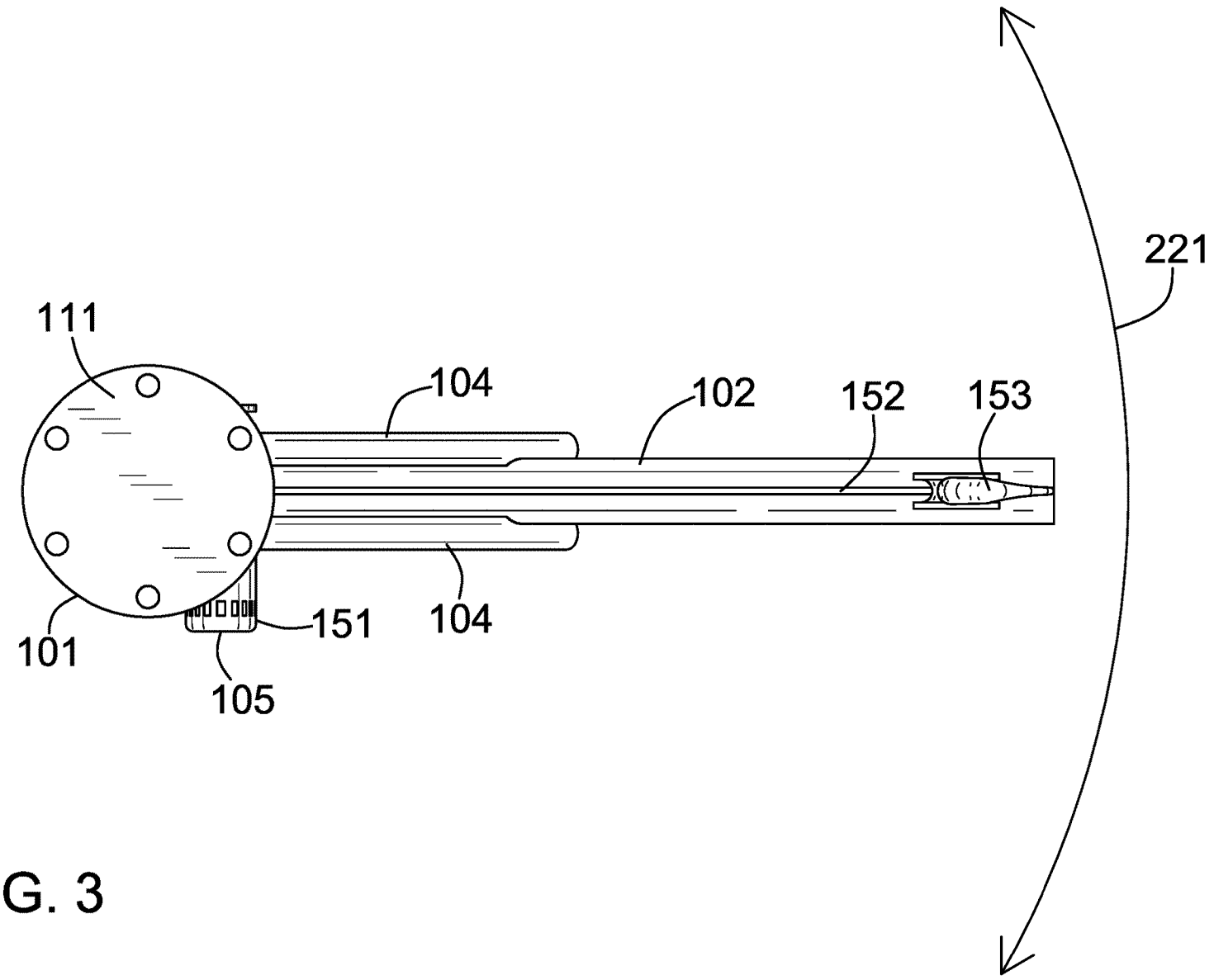
FIG. 3 is a bottom view of an embodiment of the disclosure.
Figure 4:
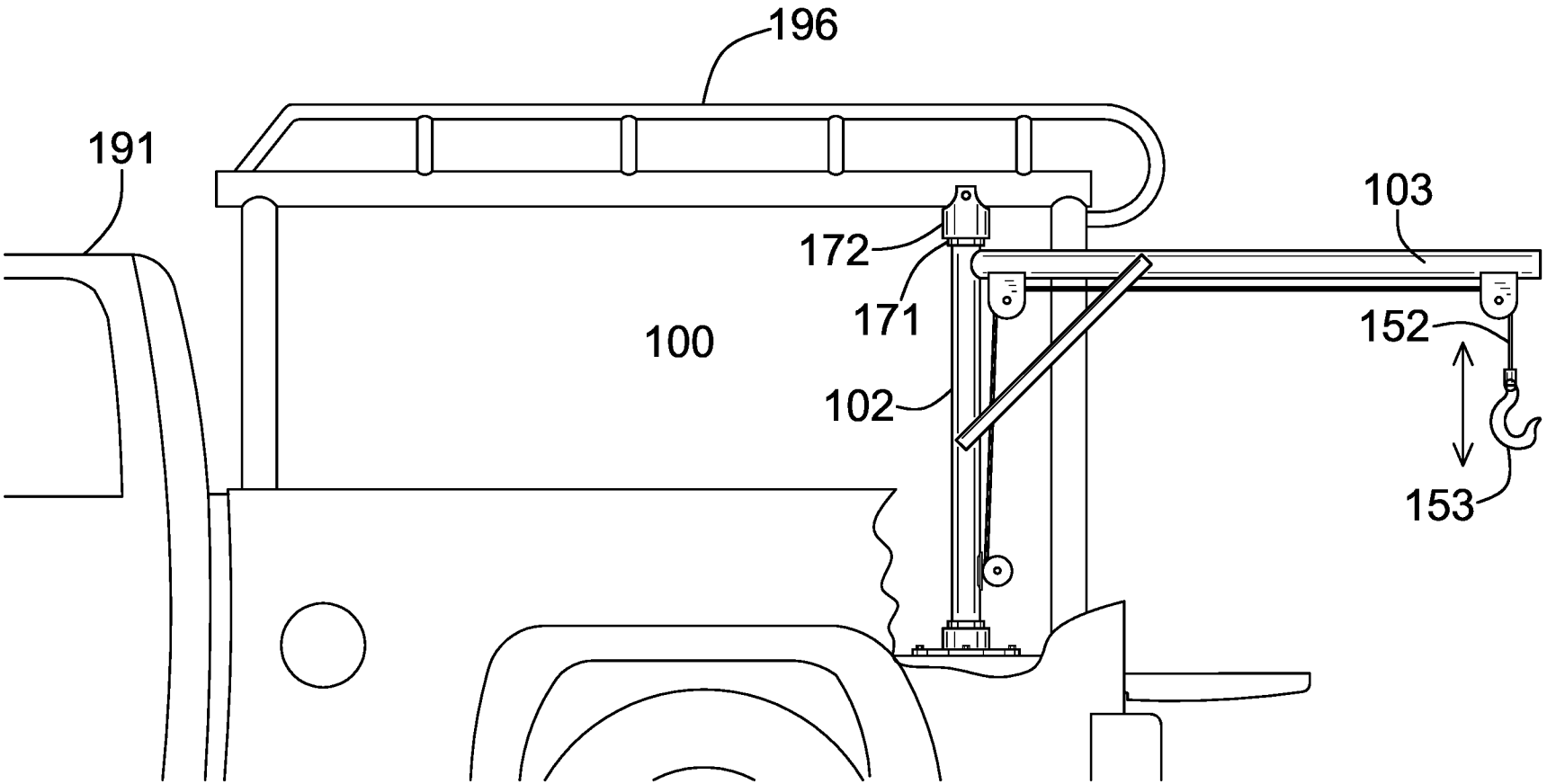
FIG. 4 is an in-use side view of an embodiment of the disclosure.
Figure 5:
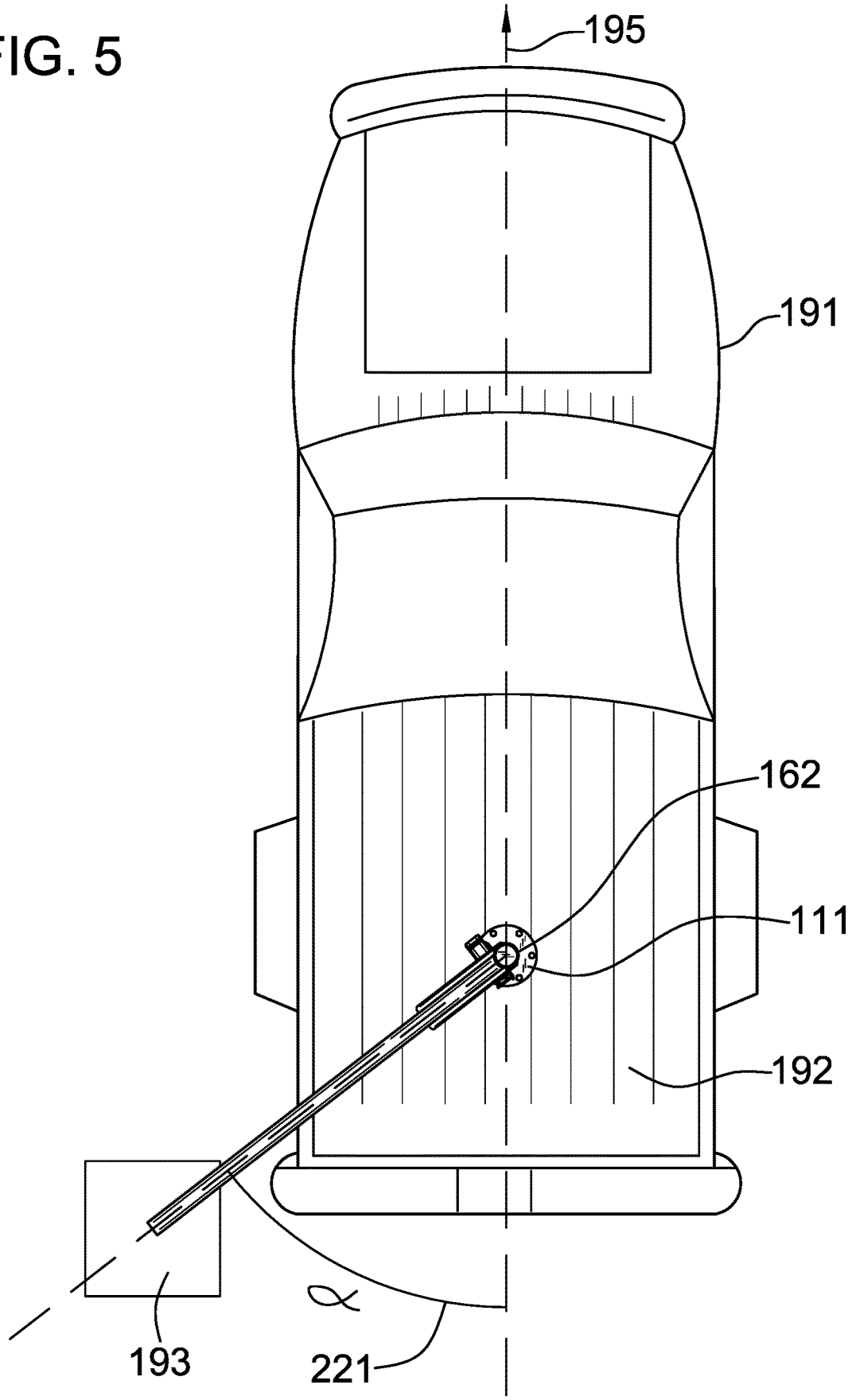
FIG. 5 is an in-use top view of an embodiment of the disclosure.

Detailed reference will now be made to one or more potential embodiments of the disclosure, which are illustrated in FIGS. 1 through 5.

The truck bed cargo hoist 100 (hereinafter invention) is configured for use with a load 193. The invention 100 is configured for use with a pickup truck 191. The pickup truck 191 is further defined with a bed 192 and a direction of forward motion 195. Optionally, the pickup truck 191 is further defined with a raised structure 196. The invention 100 mounts in the bed 192 of the pickup truck 191. The invention 100 is configured for use in raising the load 193 in the superior direction 194. The invention 100 comprises a slewing structure 101, a stanchion 102, a jib 103, a plurality of gussets 104, and a hoist system 105. The slewing structure 101, the stanchion 102, the jib 103, and the plurality of gussets 104 form the framework that supports the hoist system 105. The hoist system 105 raises and lowers the load 193. The stanchion 102, the jib 103, and the plurality of gussets 104 are interconnected. The slewing structure 101 attaches the stanchion 102 to the bed 192 of the pickup truck 191 such that the yaw angle 221 of the jib 103 is adjustable.

The pickup truck 191 is a commercially available motorized vehicle. The bed 192 refers to a level horizontal open space in the pickup truck 191 used for transporting cargo. The load 193 refers to an object that is raised and lowered by the invention 100. The raised structure 196 refers to a shelving system installed in the pickup truck 191. The raised structure 196 is intended to carry bulky items, such as lumber, at an elevation that is raised above the jib 103.

The yaw angle 221 refers to the span of the arc between the direction of forward motion 195 and the jib 103. The axis of rotation 222 is the axis around which the fourth end 204 of the jib 103 rotates. In the first potential embodiment of the disclosure, the axis of rotation 222 aligns with the center axis of the stanchion 102. The direction of forward motion 195 refers to the direction of forward motion of the pickup truck 191. The superior direction 194 refers to an axis that is parallel to the force of gravity. If the superior direction 194 is used as a vector, the direction of the superior direction 194 is opposite to the vector force of gravity.

The slewing structure 101 is a mechanical device. The slewing structure 101: 1) attaches the stanchion 102 to the bed 192 of the pickup truck 191; 2) the slewing structure 101 rotates the stanchion 102 around an axis of rotation 222 aligned with the center axis of the stanchion 102. The slewing structure 101 provides the ability required by the invention 100 to adjust the yaw angle 221 of the jib 103. The slewing structure 101 comprises a collared flange 111 and a pivot mechanism 112.

The collared flange 111 is a commercially available flange that is used to attach the stanchion 102 to the bed 192 of the pickup truck 191. The collar of the collared flange 111 forms a contained space that the stanchion 102 inserts into. The collar of the collared flange 111 prevents shifts in the stanchion 102 that would misalign the center axis of the stanchion 102 with the superior direction 194.

The pivot mechanism 112 is a rotating mechanical device formed in the slewing structure 101. The pivot mechanism 112 allows the stanchion 102 to rotate around an axis of rotation 222 aligned with the center axis of the slewing structure 101.

In the first potential embodiment of the disclosure, the pivot mechanism 112 is selected from the group consisting of a second bushing 161 and a slewing bearing 162. The second bushing 161 is a commercially available rotating bushing that attaches the first shaft 121 to the collared flange 111 of the stanchion 102. The slewing bearing 162 is a commercially available slewing bearing 162 that attaches the collared flange 111 to the bed 192 of the pickup truck 191. The use of a bushing and a slewing bearing 162 is well known and documented devices commonly used in the mechanical arts.

The stanchion 102 is a prism-shaped shaft that projects perpendicularly away from the bed 192 of the pickup truck 191. The stanchion 102 forms an extension structure that increases the span of distance in the superior direction 194 between the bed 192 of the pickup truck 191 and the jib 103. The stanchion 102 attaches to the slewing structure 101 in the manner of a cantilever. Optionally, the stanchion 102 can further support a raised structure 196 when necessary. The stanchion 102 comprises a first shaft 121 and a headpiece 122. The first shaft 121 is further defined with a first end 201, a second end 202, and an axis of rotation 222. The free end of the stanchion 102 is the second end 202.

The first shaft 121 is a prism-shaped structure that forms the extension structure of the stanchion 102. The first shaft 121 attaches to the slewing structure 101 in the manner of a cantilever.

The headpiece 122 is a structure that attaches to the second end 202 of the first shaft 121. The headpiece 122 forms a rotating pedestal structure upon which the raised structure 196 of the pickup truck 191 attaches. The headpiece 122 is designed to remain in position when: 1) the headpiece 122 supports the raised structure 196; while, 2) the first shaft 121 rotates around the axis of rotation 222. The headpiece 122 comprises a first bushing 171 and a frame footing 172.

The first bushing 171 is a commercially available rotating bushing that attaches the frame footing 172 to the first shaft 121. The frame footing 172 is a footing that is used to support a raised structure 196 installed on the pickup truck 191. The raised structure 196 inserts into a notch formed in the superior surface of the frame footing 172. When the raised structure 196 is installed on the frame footing 172, the first bushing 171 allows the stanchion 102 to rotate without shifting the position of the frame footing 172.

The jib 103 is a load 193 bearing prism-shaped structure that attaches to the stanchion 102 in the manner of a cantilever. The jib 103 is a horizontally oriented extension structure that separates the tenth end 210 of the cable 152 from the stanchion 102. The rotation of the stanchion 102 moves the fourth end 204 of the jib 103 which changes the yaw angle 221 of the jib 103. The jib 103 comprises a second shaft 130, a first pulley 131, and a second pulley 132. The second shaft 130 is further defined with a third end 203, a fourth end 204, and a yaw angle 221. The free end of the jib 103 is the fourth end 204.

The first pulley 131 is a commercially available pulley that is used to change the direction of the cable 152 from a vertical direction to a horizontal direction. The second pulley 132 is a commercially available pulley that is used to change the direction of the cable 152 from a horizontal direction to a vertical direction.

Each of the plurality of gussets 104 is a structural member that is used to strengthen the attachment between the stanchion 102 and the jib 103. The plurality of gussets 104 comprises a first gusset 141 and a second gusset 142. The first gusset 141 is a shaft that braces the first shaft 121 and the second shaft 130. The second gusset 142 is a shaft that braces the first shaft 121 and the second shaft 130. The first gusset 141 is further defined with a fifth end 205 and a sixth end 206. The second gusset 142 is further defined with a seventh end 207 and an eighth end 208.

The hoist system 105 is an electrically powered device that physically raises and lowers the load 193 in the superior direction 194. By using the hoist system 105 to raise the load 193 and the slewing structure 101 to change the yaw angle 221 of the stanchion 102, the invention 100 can lift and move objects as required in a situation. The hoist system 105 comprises a winch 151, a cable 152, and a hook 153. The cable 152 is further defined with a ninth end 209 and a tenth end 210.

The winch 151 is an electrically powered device that dispenses and retracts the cable 152. The winch 151 is discussed in greater detail elsewhere in this disclosure. The cable 152 is a cord formed from metal wires. By changing the amount of cable 152 dispensed by the winch 151, the cable 152 physically raises and lowers the load 193. The hook 153 is a fastening structure that attaches the load 193 to the cable 152. In the first potential embodiment of the disclosure, the hook 153 is a curved structure.

The winch 151 comprises a winch motor 181, a winch spool 182, and a winch plate 183. The winch motor 181 is an electrical motor that dispenses and retracts the cable 152. The winch motor 181 provides the force necessary to suspend the load 193 above a supporting surface. The winch spool 182 is a cylindrical structure upon which the cable 152 is wound after it has been retracted into the winch 151. The winch plate 183 is a metal plate that attaches the winch 151 to the stanchion 102. The winch plate 183 is welded to the stanchion 102. The winch motor 181 may have a switch (not depicted) in an unspecified location that is responsible for winding or unwinding of the cable 152 with respect to the winch spool 182.

The following four paragraphs detail the assembly of the invention 100.

The slewing structure 101 attaches to the bed 192 of the pickup truck 191. The first end 201 of the first shaft 121 attaches to the slewing structure 101 such that the first end 201 inserts into the collar of the collared flange 111. The first end 201 of the first shaft 121 installs in the slewing structure 101 such that the stanchion 102 rotates around the axis of rotation 222. The headpiece 122 attaches to the second end 202 of the first shaft 121. The first bushing 171 attaches the frame footing 172 to the second end 202 such that the frame footing 172 rotates around the axis of rotation 222.

The third end 203 of the second shaft 130 attaches to the lateral face of the first shaft 121 at a location proximal to the second end 202 of the first shaft 121. The second shaft 130 attaches to the first shaft 121 such that the center axis of the second shaft 130 intersects perpendicularly with the axis of rotation 222. The fifth end 205 of the first gusset 141 attaches to the lateral face of the stanchion 102. The sixth end 206 of the first gusset 141 attaches to the lateral face of the jib 103. The seventh end 207 of the second gusset 142 attaches to the lateral face of the stanchion 102. The eighth end 208 of the second gusset 142 attaches to the lateral face of the jib 103.

The first pulley 131 attaches the lateral face of the second shaft 130 at a location proximal to the third end 203 of the second shaft 130. The second pulley 132 attaches the lateral face of the second shaft 130 at a location proximal to the fourth end 204 of the second shaft 130.

The winch 151 attaches to the lateral face of the first shaft 121. Specifically, the winch plate 183 attaches the winch motor 181 and the winch spool 182 to the lateral face of the first shaft 121. The ninth end 209 of the cable 152 attaches to the winch spool 182 of the winch 151. The tenth end 210 of the cable 152 threads through the first pulley 131 and the second pulley 132 such that the tenth end 210 of the cable 152 hangs from the fourth end 204 of the second shaft 130. The hook 153 attaches to the tenth end 210 of the cable 152.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Beam: As used in this disclosure, a beam is a horizontally oriented shaft that: 1) is suspended above a supporting surface; and, 2) bears a load.

Bushing: As used in this disclosure, a bushing is a cylindrical aperture through which an object is guided and potentially secured. Bushings are often used as protective linings. See Grommet Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Collar: As used in this disclosure, a collar is a ring-like device that secures an object in a position.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Electric Motor: In this disclosure, an electric motor is a machine that converts electric energy into rotational mechanical energy.

Flange: As used in this disclosure, a flange is a protruding rib, edge, or collar that is used to hold an object in place or to attach a first object to a second object.

Force of Gravity: As used in this disclosure, the force of gravity refers to a vector that indicates the direction of the pull of gravity on an object at or near the surface of the earth.

Framework: As used in this disclosure, a framework refers to the substructure of an object that carries the load path of the object.

Gusset: As used in this disclosure, a gusset is a structural member used to support an angled load bearing section of a framework.

Hoist: As used in this disclosure, a hoist is an electrically powered device lifts objects from a location that is above the object. A hoist is a form of a winch.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Lateral: As used in this disclosure, the term lateral refers to the movement of an object that is perpendicular to the previously determined or expected direction of movement of the object.

Load: As used in this disclosure, the term load refers to an object that upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Motor: As used in this disclosure, a motor refers to the method of transferring energy from an external power source into rotational mechanical energy.

Pedestal: As used in this disclosure, a pedestal is an intermediary load bearing structure that that transfers a load path between a supporting surface and an object, structure, or load.

Pickup Truck: As used in this disclosure, a pickup truck is a vehicle having an enclosed cab and an open body comprising low sides and a tailgate that is powered by an internal combustion engine. A pickup truck is further defined with a bed, a tailgate, a left sidewall, and a right sidewall.

Pitch: As used in this disclosure, the term pitch refers to the rotation or oscillation of a vehicle around the lateral axis of a vehicle. When a vehicle is resting in a normal position on a level surface, the lateral axis is defined as the axis that: 1) is perpendicular to the roll axis; and, 2) is parallel to the level surface. In this definition, the level surface is strictly a reference in the sense that the definition of the lateral angle remains unchanged should the surface change. The lateral angle is also commonly referred to as the pitch axis. More colloquially, the pitch would be referred to as moving the nose of the vehicle up or down.

Prism: As used in this disclosure, a prism is a 3-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pulley: As used in this disclosure a pulley is a wheel with a grooved rim around which a cord (or another form of rope, line, or cable) passes. The pulley is used to change the direction of a force applied to the cord.

Roll: As used in this disclosure, the term roll refers to a rotation or oscillation of a vehicle around the axis of the vehicle that is defined by the nominal direction of travel of the vehicle. This described axis is commonly referred to as the roll axis or the longitudinal axis. By nominal direction of travel of the vehicle is meant the anticipated forward or backward direction of a vehicle or, more colloquially, the direction the front of the vehicle is going. An example of a difference between the nominal direction of travel and the actual direction of travel occurs with aircraft in a heavy crosswind. In this situation, the actual direction of travel of the aircraft will not align with the longitudinal axis.

Slew: As used in this disclosure, to slew means to turn or rotate an object around a fixed point or axis.

Slewing Bearing: As used in this disclosure, a slewing bearing is a device that is used to rotate an object on a horizontal surface. Slewing bearings are often called turntable bearings or a lazy Susan bearing.

Spool: As used in this disclosure, a spool is a cylindrical device upon which a flexible material, including but not limited to a yarn, a cord, or a tape, can be wound. Depending on context, a spool may also contain the flexible material stored upon the spool.

Stanchion: As used in this disclosure, a stanchion refers to a vertical pole, post, or support. Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Suspend: As used in this disclosure, to suspend an object means to support an object such that the inferior end of the object does not form a significant portion of the load path of the object.

Vehicle: As used in this disclosure, a vehicle is a motorized device that is used for transporting passengers, goods, or equipment. The term motorized vehicle refers to a vehicle can move under power provided by an electric motor or an internal combustion engine.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Winch: As used in this disclosure, a winch is a device that comprises a cord and a rotating spool. The cord is wound on the spool. The winch is used to move or lift an object by: 1) partially unwinding the cord from the rotating spool; 2) attaching the free end of the cord to the object to be moved or lifted; and, 3) winding the cord back on to the rotating spool in order to move or lift the object.

Yaw: As used in this disclosure, the term yaw refers to the rotation or oscillation of a vehicle around the perpendicular axis of a vehicle. The perpendicular axis is defined as the axis that: 1) is perpendicular to the roll axis; and, 2) perpendicular to the pitch axis. The perpendicular axis is also commonly referred to as the yaw axis. More colloquially, yaw would be referred to as a spin.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobile hoist comprising:
a slewing structure, a stanchion, a jib, a plurality of gussets, and a hoist system;
wherein the slewing structure, the stanchion, the jib, and the plurality of gussets form a framework that supports the hoist system;
wherein the stanchion, the jib, and the plurality of gussets are interconnected;
wherein the pickup truck is further defined with a bed, a raised structure, and a direction of forward motion;
wherein the slewing structure attaches the stanchion to the bed of the pickup truck such that a yaw angle of the jib is adjustable;
wherein the yaw angle is the span of the arc between the direction of forward motion and the jib;
wherein the mobile hoist is configured for use with a load;
wherein the hoist system raises and lowers the load;
wherein the mobile hoist is configured for use with a pickup truck;
wherein the mobile hoist mounts in the bed of the pickup truck;
wherein the slewing structure is a mechanical device that attaches the stanchion to the bed of the pickup truck;
wherein the slewing structure rotates the stanchion around an axis of rotation aligned with a center axis of the stanchion;
wherein the slewing structure comprises a collared flange and a pivot mechanism;
wherein the pivot mechanism is a rotating mechanical device formed in the slewing structure;
wherein the stanchion projects perpendicularly away from the bed of the pickup truck;
wherein the stanchion attaches to the slewing structure in the manner of a cantilever;
wherein the stanchion forms an extension structure that increases the span of distance between the bed of the pickup truck and the jib;
wherein the stanchion supports the raised structure.

2. The mobile hoist according to claim 1
wherein the jib is a load-bearing structure;
wherein the jib is a prism-shaped structure;
wherein the jib attaches to the stanchion in the manner of a cantilever;
wherein the jib is a horizontally oriented extension structure.

3. The mobile hoist according to claim 2 wherein each of the plurality of gussets is a structural member that is used to strengthen the attachment between the stanchion and the jib.

4. The mobile hoist according to claim 3
wherein the hoist system is an electrically powered device;
wherein the hoist system physically raises and lowers the load.

5. The mobile hoist according to claim 4
wherein the collared flange attaches the stanchion to the bed of the pickup truck;
wherein the pivot mechanism allows the stanchion to rotate around the axis of rotation aligned with a center axis of the slewing structure.

6. The mobile hoist according to claim 5
wherein the stanchion comprises a first shaft and a headpiece;
wherein the headpiece attaches to the first shaft;
wherein the first shaft is further defined with a first end, a second end, and the axis of rotation.

7. The mobile hoist according to claim 6
wherein the headpiece forms a rotating pedestal structure upon which the raised structure of the pickup truck attaches.

8. The mobile hoist according to claim 7
wherein the first shaft is a prism-shaped structure;
wherein the first shaft attaches to the slewing structure in the manner of a cantilever.

9. The mobile hoist according to claim 8
wherein the headpiece comprises a first bushing and a frame footing;
wherein the first bushing attaches the frame footing to the first shaft;
wherein the frame footing is a footing that attaches to the raised structure;
wherein the first bushing allows the stanchion to rotate without shifting the position of the frame footing.

10. The mobile hoist according to claim 9
wherein the jib comprises a second shaft, a first pulley, and a second pulley;
wherein the first pulley and the second pulley attach to the second shaft;
wherein the second shaft is further defined with a third end, a fourth end, and a yaw angle;
wherein the rotation of the stanchion changes the yaw angle.

11. The mobile hoist according to claim 10
wherein the first pulley changes the direction of the cable from a vertical direction to a horizontal direction;
wherein the second pulley changes the direction of the cable from a horizontal direction to a vertical direction.

12. The mobile hoist according to claim 11
wherein the plurality of gussets comprises a first gusset and a second gusset;
wherein the first gusset is a shaft that braces the first shaft and the second shaft;
wherein the second gusset is a shaft that braces the first shaft and the second shaft;
wherein the first gusset is further defined with a fifth end and a sixth end;
wherein the second gusset is further defined with a seventh end and an eighth end.

13. The mobile hoist according to claim 12
wherein the hoist system comprises a winch, a cable, and a hook;
wherein the cable attaches the hook to the winch;
wherein the hook attaches the load to the cable;

wherein the cable is further defined with a ninth end and a tenth end.

14. The mobile hoist according to claim 13 wherein the winch is an electrically powered device;

wherein the winch dispenses and retracts the cable;

wherein the cable is a cord;

wherein the cable is formed from metal wires;

wherein the hook is a curved structure.

15. The mobile hoist according to claim 14 wherein the winch comprises a winch motor, a winch spool, and a winch plate;

wherein the winch motor is an electrical motor;

wherein the winch motor provides the force necessary to suspend the load above a supporting surface;

wherein the winch spool is a cylindrical structure upon which the cable is wound;

wherein the winch plate is a metal plate that attaches the winch to the stanchion;

wherein the winch plate is welded to the stanchion.

16. The mobile hoist according to claim 15 wherein the slewing structure attaches to the bed of the pickup truck;

wherein the first end of the first shaft attaches to the slewing structure such that the first end inserts into the collar of the collared flange;

wherein the first end of the first shaft installs in the slewing structure such that the stanchion rotates around the axis of rotation;

wherein the headpiece attaches to the second end of the first shaft;

wherein the first bushing attaches the frame footing to the second end such that the frame footing rotates around the axis of rotation;

wherein the third end of the second shaft attaches to a lateral face of the first shaft at a location proximal to the second end of the first shaft;

wherein the second shaft attaches to the first shaft such that the center axis of the second shaft intersects perpendicularly with the axis of rotation;

wherein the fifth end of the first gusset attaches to a lateral face of the stanchion;

wherein the sixth end of the first gusset attaches to a lateral face of the jib;

wherein the seventh end of the second gusset attaches to lateral face of the stanchion;

wherein the eighth end of the second gusset attaches to lateral face of the jib;

wherein the first pulley attaches a lateral face of the second shaft at a location proximal to the third end of the second shaft;

wherein the second pulley attaches lateral face of the second shaft at a location proximal to the fourth end of the second shaft;

wherein the winch attaches to lateral face of the first shaft;

wherein the winch plate attaches the winch motor and the winch spool to lateral face of the first shaft;

wherein the ninth end of the cable attaches to the winch spool of the winch;

wherein the tenth end of the cable threads through the first pulley and the second pulley such that the tenth end of the cable hangs from the fourth end of the second shaft;

wherein the hook attaches to the tenth end of the cable.

17. The mobile hoist according to claim 1 wherein the pivot mechanism is selected from the group consisting of a second bushing and a slewing bearing;

wherein the second bushing attaches the first shaft to the collared flange of the stanchion;

wherein the slewing bearing attaches the collared flange to the bed of the pickup truck.

* * * * *